United States Patent [19]

Allison

[11] Patent Number: 4,855,166

[45] Date of Patent: Aug. 8, 1989

[54] ARTIFICIAL PINE NEEDLE

[76] Inventor: John G. Allison, 259 Rosman Hwy., Brevard, N.C. 28712

[21] Appl. No.: 279,546

[22] Filed: Dec. 5, 1988

[51] Int. Cl.[4] ..... A41G 1/00

[52] U.S. Cl. ..... 428/15; 47/9; 428/17; 428/21; 428/919

[58] Field of Search ..... 47/9; 156/61; 428/15, 428/17, 18, 21, 919

[56] References Cited

U.S. PATENT DOCUMENTS

| | | | |
|---|---|---|---|
| 3,525,659 | 8/1970 | Ebihara | 428/18 |
| 3,791,421 | 2/1974 | Barrett | 428/18 X |
| 3,900,637 | 8/1975 | Byrd et al. | 428/9 |
| 4,161,768 | 7/1979 | Gauthier et al. | 428/8 X |
| 4,171,401 | 10/1979 | Legrix et al. | 428/17 X |
| 4,462,065 | 7/1984 | Rhodes | 362/123 X |
| 4,573,247 | 3/1986 | Spinelli | 428/18 X |
| 4,609,576 | 9/1986 | Liu | 428/18 |

OTHER PUBLICATIONS

Frank & Ernest by Bob Thaves—comic strip p. E1-0—The Washington Post, Friday, Dec. 17, 1982.

*Primary Examiner*—Henry F. Epstein
*Attorney, Agent, or Firm*—David M. Carter

[57] ABSTRACT

There is provided an artificial pine needle including a plurality of strands each of which may be made from an olefin material. The strands are adjacent and somewhat parallel to one another. The strands are attached to one another on one end. The strands have appearance and characteristics to emulate a natural pine needle. The artificial pine needles are used as a synthetic ground cover.

16 Claims, 1 Drawing Sheet

ARTIFICIAL PINE NEEDLE

BACKGROUND OF THE INVENTION

This invention relates to synthetic ground cover. More particularly, it relates to artificial pine needles for use as a ground cover.

Naturally occurring pine needles have been used for years as a ground cover especially around bedding plants. However, the use of pine needles as a ground cover has been somewhat restricted to places where pine needles grow such as, for example, the Southeastern United States. This is primarily due to the cost involved in transporting pine needles to other regions. Recently the use of pine needles as a ground cover has become extremely popular. Pine needles are very attractive and relatively inexpensive, particularly as compared to pine bark, and covers more ground than pine bark per unit weight.

The more popular pine needle is the long leaf needle which is longer than the loblolly pine needle and easier to bale. The color of the long leaf pine needle is also more attractive to gardeners.

The use of natural pine needles as ground cover does have several drawbacks. First of all, it is a labor intensive process to gather the pine needles since the needles must be raked from the pine forest floor and then baled. In some cases equipment can be used for raking, however, often, particularly in natural stands of trees, hand raking is necessary. Furthermore, the raked pine needles must be cleaned of contaminants such as sticks, twigs, and other items which will also occur on the forest floor. Also, because the pine needles have a high acid content, the gardener quite often must use lime on the soil where the pine needles are to be placed in order to balance the PH of the soil. In addition, natural pine needles are highly flammable and thus create a dangerous fire hazard, particularly when used near a building.

OBJECTS OF THE INVENTION

It is therefore one object of this invention to provide an artificial pine needle.

It is another object to provide an artificial pine needle which has similar characteristics to a natural pine needle, particularly the long leaf pine needle.

It is another object to provide an artificial pine needle which is easy and inexpensive to produce.

It is another object to provide an artificial pine needle which will act as a ground cover and will assist in the stabilization of the soil.

SUMMARY OF THE INVENTION

In accordance with one form of this invention, there is provided an artificial pine needle having a plurality of strands. The strands are preferably at least partly made of an olefin material. The strands are adjacent and somewhat parallel to one another. A mechanism is provided for attaching the strands together at one end of each strand. The strands are not attached to one another for the major portion of the length of the strands. Preferably the strands are of a thickness, weight, and shape so as to emulate the physical characteristics of a natural pine needle.

In accordance with another form of this invention, there is provided an article for use as a ground cover including at least one elongated strand made of a synthetic material. A first portion of the periphery of the cross section of the strand is curved and a second portion of the periphery is in the shape of a point. The point may make contact with an adjacent needle forming a part of the ground cover or it may make contact with the ground itself to provide a friction so as to aid in soil stabilization.

The strands may be formed into the shape of a pine needle by extruding an olefin material using known techniques. The resulting artificial or synthetic pine needles are scattered on the ground forming a synthetic ground cover.

BRIEF DESCRIPTION OF THE DRAWINGS

The subject matter which is regarded as the invention is set forth in the appended claims. The invention itself, however, together with further objects and advantages thereof, may be better understood by reference to the following description taken in conjunction with the accompanying drawings in which:

DESCRIPTION OF THE PREFERRED EMBODIMENTS

Figure 1:
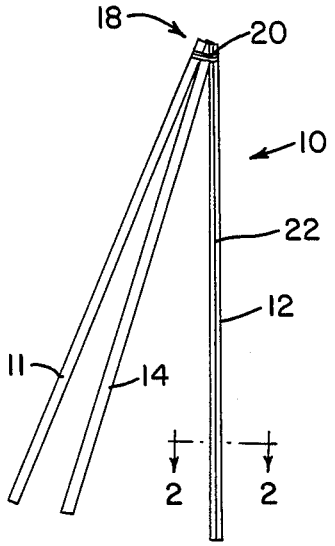
FIG. 1 is a pictorial view showing one form of a pine needle of the subject invention.
Figure 2:
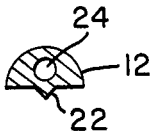
FIG. 2 is a cross sectional view of one of the strands of the pine needle of FIG. 1 taken through Section Line 2-2.

Referring now more particularly to FIG. 1, there is provided artificial pine needle 10 which in this embodiment includes three strands 12, 14, and 16. The strands are attached to one another at one end 18. In this embodiment the attachment mechanism is glue 20, however the strands may be attached to one another by means of melting the ends together by the use of heat or by tieing the ends together. Each strand includes elongated pointed ridge 22 as illustrated on strand 12. The pointed ridge may also be seen in reference to FIG. 2 which is a sectional view of strand 12. Point 22 is somewhat triangularly shaped in the cross sectional view and provides friction or traction to hold adjacent pine needles together and also for holding the pine needles onto the ground. Preferably each pine needle includes elongated hollow space 24 to save material and to lighten the weight of the needle. Preferably the pine needle is made of an olefin material which may be readily extruded or spun into the desired shape. The preferred olefin is polypropylene although polyethylene and other synthetic materials may also be utilized. Polypropylene has a higher melting point than polyethylene and is relatively inexpensive. A flame retardant to substantially reduce flammability may be added to the olefin, particularly if polyethylene is used. Examples of acceptable flame retardants are boric acid, alumina trihydrate, brominated aromatics, halogenated aliphatics, and phosphate esters.

In order for the artificial pine needle to most closely resemble the long leaf pine needle, which is the preferred ground cover, the olefin should be colored prior to extrusion so that the resulting pine needle will be a brown or a reddish brown in color. Colorants include both dyes and pigments. Iron oxide is a suitable colorant.

It is preferred that the artificial pine needles be reasonably stiff yet resilient in a similar fashion as natural pine needles. In order to achieve the proper stiffness and yet give the appearance of a natural pine needle, it is preferred that the thickness of the pine needle across its widest points be between 0.10 and 0.20 centimeters.

It is further preferred that hollow space 24 occupy no more than 50 percent of each strand so as to maintain appropriate wall thickness and strength.

It has been found that the lengths and weights of natural long leaf pine needles (44 samples) randomly gathered substantially follow a normal distribution curve between 18 centimeters and 33 centimeters in length and 0.15 grams in 0.47 grams in weight. Since the long leaf pine needle is the most desired needle, it is therefore preferred that the pine needle be no less than 18 centimeters and no more than 33 centimeters in length and it is also preferred that each pine needle be no less than 0.15 grams and no more than 0.47 grams in weight.

A filler may be added to the olefin primarily to reduce the cost of the artificial pine needle. The filler may replace up to 50 percent by weight of the olefin. If the filler has a higher specific quantity than the olefin, the weight of the artificial pine needle may increase beyond the range set forth above. Calcium carbonate is the preferred filler because it is inexpensive, reduces flammability and readily accepts many colorants. Other fillers such as chalk, glass, diatomaceous earth and talc may also be used.

The pine needle strands may be manufactured by known extrusion processes including wet extrusion, dry extrusion, and melt extrusion. After the extruded strands are cooled and hardened they may be cut into the appropriate lengths for a particular pine needle. It is preferred that the colorants, flame retardants, and fillers are added to the olefin prior to extrusion by blending those materials into the melted olefin.

From the foregoing description of the illustrative embodiments of the invention, it will be apparent that many modifications may be made therein. It should be understood therefore that these embodiments of the invention are intended as an exemplification of the invention only and that this invention is not limited thereto. It is to be understood, therefore, that it is intended that the claims are to cover all such modifications that shall fall within the true spirit and scope of the invention.

I claim:

1. An artificial pine needle comprising: a plurality of strands; said strands being at least partially made of a synthetic material; said strands being somewhat parallel and adjacent to one another;

means for attaching said strands together at one end of each strand; said strands not being attached to one another for the major portion of the length of said strands.

2. An artificial pine needle as set forth in claim 1 wherein said synthetic material is an olefin.

3. An artificial pine needle as set forth in claim 2 including a colorant mixed with said olefin material.

4. An artificial pine needle as set forth in claim 3 wherein said colorant is taken from the group consisting essentially of dyes and pigments.

5. An artificial pine needle as set forth in claim 2 wherein said olefin is polypropylene.

6. An artificial pine needle as set forth in claim 2 wherein said olefin is polyethylene.

7. An artificial pine needle as set forth in claim 2 further including a flame retardant mixed with said olefin material.

8. An artificial pine needle as set forth in claim 7 wherein said flame retardant is taken from the group consisting essentially of boric acid, alumina trihydrate, brominated aromatics, halogenated aliphatics, and phosphate esters.

9. An artificial pine needle as set forth in claim 2 further including a filler mixed with said olefin.

10. An artificial pine needle as set forth in claim 9 wherein said filler is calcium carbonate.

11. An artificial pine needle as set forth in claim 1 wherein the major diameter of said strands are in the range of from 0.10 to 0.20 centimeters.

12. An artificial pine needle as set forth in claim 1 wherein said pine needles have a partial cross sectional shape essentially in the shape of a semicircle.

13. An artificial pine needle as set forth in claim 12 further including a point extending from the straight portion of said semicircle.

14. An artificial pine needle as set forth in claim 1 wherein said strands include a hollow portion.

15. An artificial pine needle as set forth in claim 1 having a weight in the range 0.15 grams to 0.47 grams.

16. an artificial pine needle as set forth in claim 1 having a length in the range of from 18 centimeters to 33 centimeters.

* * * * *